US010610723B2

(12) United States Patent
Endelman et al.

(10) Patent No.: US 10,610,723 B2
(45) Date of Patent: Apr. 7, 2020

(54) ULTRA CLASSIC REFORMER APPARATUS

(71) Applicant: Balanced Body, Inc., Sacramento, CA (US)

(72) Inventors: Ken Endelman, Sacramento, CA (US); Kit W. Spelman, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 133 days.

(21) Appl. No.: 15/950,047

(22) Filed: Apr. 10, 2018

(65) Prior Publication Data

US 2019/0308058 A1 Oct. 10, 2019

(51) Int. Cl.

| | |
|---|---|
| ***A63B 21/02*** | (2006.01) |
| ***A63B 21/00*** | (2006.01) |
| ***A63B 21/04*** | (2006.01) |

(52) U.S. Cl.

CPC ..... *A63B 21/4031* (2015.10); *A63B 21/023* (2013.01); *A63B 21/0442* (2013.01); *A63B 21/4034* (2015.10); *A63B 21/4045* (2015.10)

(58) Field of Classification Search

CPC ..... A63B 22/0076; A63B 22/0087; A63B 22/0089; A63B 22/20; A63B 2225/107; A47B 47/021; A47B 91/00

See application file for complete search history.

(56) References Cited

U.S. PATENT DOCUMENTS

| | | | | |
|---|---|---|---|---|
| 1,621,477 | A | 3/1927 | Pilates | |
| 5,695,263 | A | 12/1997 | Simon et al. | |
| 6,120,425 | A | 9/2000 | Endelman | |
| 6,371,895 | B1 * | 4/2002 | Endelman | A63B 21/023 482/101 |
| 7,163,500 | B2 | 1/2007 | Endelman et al. | |
| 7,288,053 | B2 | 10/2007 | Endelman et al. | |
| 2003/0195095 | A1 | 10/2003 | Endelman et al. | |
| 2014/0338125 | A1 | 11/2014 | Polevoy et al. | |
| 2018/0027980 | A1 | 2/2018 | Kramer et al. | |

OTHER PUBLICATIONS

International Search Report and Written Opinion, dated Jul. 2, 2019, from corresponding International App. No. PCT/US2018/022697.

* cited by examiner

*Primary Examiner* — Loan B Jimenez
*Assistant Examiner* — Andrew M Kobylarz
(74) *Attorney, Agent, or Firm* — Greenberg Traurig, LLP

(57) ABSTRACT

A rectangular frame for a reformer exercise apparatus is disclosed which includes a pair of spaced apart side rail members, a head end member, a foot end member; and four corner members, each joining one of the side rail members to one of the end members. Each side rail member and each end member is a rigid generally rectangular extrusion. The top wall, the bottom wall and the inner vertical wall have interior screw races. The outer vertical wall has a pair of spaced interior projecting screw races. Each corner member is fastened to one of the end members and one of the side members by threaded fasteners projecting from the screw races through apertures in the L shaped elongated corner member, and an L shaped cover hides these fasteners from view.

19 Claims, 7 Drawing Sheets

ULTRA CLASSIC REFORMER APPARATUS

BACKGROUND OF THE DISCLOSURE

The present disclosure is directed to exercise equipment and more particularly to a reformer exercise apparatus having an all metal frame of simplified construction.

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. One current apparatus is commonly referred to as a "reformer" which includes a wheeled platform carriage which rides on parallel rails or tracks on or forming part of a rectangular wooden or metal frame. The carriage is connected to a series of parallel springs or elastic members which are in turn connected to a foot end of the rectangular frame. My U.S. Pat. Nos. 6,120,425, 7,163,500 and 7,288,053 reflect some of the evolutionary developments that have taken place since 1927.

A reformer generally has a rectangular frame that includes four legs, one at each corner. The sides and ends of wood frame reformers have corner joints assembled via conventional wood joinery techniques. Metal frame reformers have corner joints that are welded together such as the Gratz reformer manufactured by Gratz Industries LLC, or may be joined as taught by one of my US patents, for example, U.S. Pat. No. 6,971,976, among others. One difficulty with a reformer frame that has welded corners with legs is that it cannot thereafter be non-destructively disassembled for any reason, and, if made of steel, is quite heavy. Therefore there is a need for a simplified rigid reformer frame structure that can be easily disassembled while retaining the clean appearance and stability of a unitary rigid frame structure.

SUMMARY OF THE DISCLOSURE

An exemplary embodiment of a reformer apparatus in accordance with the present disclosure meets the above identified need. One embodiment of an exercise apparatus in accordance with the present disclosure includes a rectangular frame having a pair of spaced apart side rail members, a head end member and a foot end member, and a corner member joining each side rail member to one of the head end member and the foot end members. A carriage is positioned between the side rail members for movement back and forth between the rail members. An elastic member is fastened between the foot end member and the carriage that resiliently biases the carriage toward the foot end member.

Each of the side rail members and each end member is a rigid extrusion having, in cross section, an outer vertical wall, an inner vertical wall, a top wall joining the outer vertical wall to the inner vertical wall, and a bottom wall joining the outer vertical wall to the inner vertical wall. Each of the top wall, the bottom wall and the inner vertical wall has an interior projecting single screw race formed therein extending along the length of the extrusion. The outer vertical wall has a pair of spaced interior projecting screw races formed therein, also extending along the length of the extrusion.

The screw races formed in the walls of each side rail member and head and foot end member are identically located within the extrusions. The inner vertical wall screw race is equidistant from the top wall and the bottom wall. The pair of spaced interior projecting screw races in the outer vertical wall are equidistantly spaced from the inner vertical wall screw race. Each side rail member extrusion has a flat flange extending from the bottom wall at a right angle from the inner wall adjacent the bottom wall. This flat flange forms one rail for supporting the carriage for movement back and forth between the end members.

Each corner member of the rectangular frame is a rigid elongated extrusion having an L shape cross section having a first leg and a second leg extending at a right angle from the first leg. Each corner member is fastened to one of the end members and one of the side members by threaded fasteners each projecting from one of the screw races. Each side rail member and end member has a plurality of threaded fasteners each extending from one of the screw races through a corresponding aperture through one of the legs of the corner member. Preferably each side rail member and end member has three threaded fasteners each extending from one of the screw races.

Each corner member has an upper end and a lower end and five symmetrically spaced apertures through each leg adjacent the upper end, each aperture being in a position opposite one of the screw races in the one of the side rail member or end member abutting the corner member. These apertures are symmetrically spaced on each leg so as to correspond to the positions of the screw races in both the side rail member and the end members, such that the side and end members may be interchangeably fastened thereto. Each leg of the corner member receives three fasteners extending through three apertures from corresponding screw races in one of the rail member and one of the end member. Each corner member has a boss formed at the distal end of each leg, the boss forming an elongated groove along the length of the leg for receiving a cover to hide the fasteners from view. Each fastener comprises a threaded stud threaded into one of the screw races in the extrusion. The assembled frame further includes a nut fastened to each threaded stud protruding through one of the apertures to draw the rail and end members together.

An embodiment of an exercise apparatus frame in accordance with the present disclosure preferably includes a corner member for joining a side rail member and an end member of a reformer exercise apparatus frame. This corner member preferably includes an elongated rigid extrusion having an L shape cross section forming right angle legs. The extrusion has an upper end and a lower end, and a boss formed at the distal end of each leg forming an elongated groove that extends along the length of the corner member leg. The corner member also includes an elongated corner cover having right angle sides. This cover preferably has distal edge ribs on the sides configured to slide within the boss grooves at the distal ends of each of the legs of the extrusion. The corner member also preferably includes a top cover shaped to cover the upper end of the rigid extrusion and a top end portion of the corner cover, and a foot pad receiving a bottom end of the rigid extrusion. The elongated corner cover has an internally facing screw race between the sides for receiving a fastener through the foot pad. The top cover has a portion projecting downward into the internally facing screw race when the top cover is placed on the corner cover.

An embodiment of a rectangular frame for a reformer exercise apparatus in accordance with the present disclosure may be viewed as a frame including a pair of spaced apart side rail members, a head end member, foot end member, and four corner members, each joining one of the side rail members to one of the end members. Each side rail member and each end member is a rigid extrusion preferably made of a high strength rigid metal or plastic material such as aluminum and having, in cross section, an outer vertical wall, an inner vertical wall, a top wall joining the outer vertical wall to the inner vertical wall, and a bottom wall joining the outer vertical wall to the inner vertical wall, each of the top wall, the bottom wall and the inner vertical wall having an interior projecting single screw race, and the outer vertical wall having a pair of spaced interior projecting screw races.

Each corner member is fastened to one of the end members and one of the side members by threaded fasteners each projecting from one of the screw races through an aperture in one of the corner members. Each corner member is an elongated rigid extrusion having side walls or legs at a right angle, the extrusion having an upper end and a lower end. Each corner member leg has a set of five spaced apart apertures adjacent the upper end facing and aligned with the screw races in an abutting one of the side and end members, three of which each receive therethrough a fastener extending from one of the screw races in the abutting one of the side and end members. The corner member extrusion has a boss at the distal end of each leg forming an elongated groove along the length of the extrusion for receiving an elongated corner cover having right angle sides, the cover having distal edge ribs on the sides configured to slide within the boss grooves at the distal ends of the legs of the extrusion. The corner member also includes a top cover shaped to cover the upper end of the rigid extrusion and a top end portion of the corner cover and a foot pad receiving a bottom end of the rigid corner member extrusion.

Further features, advantages and characteristics of the embodiments of this disclosure will be apparent from reading the following detailed description when taken in conjunction with the drawing figures.

DETAILED DESCRIPTION

Figure 1:
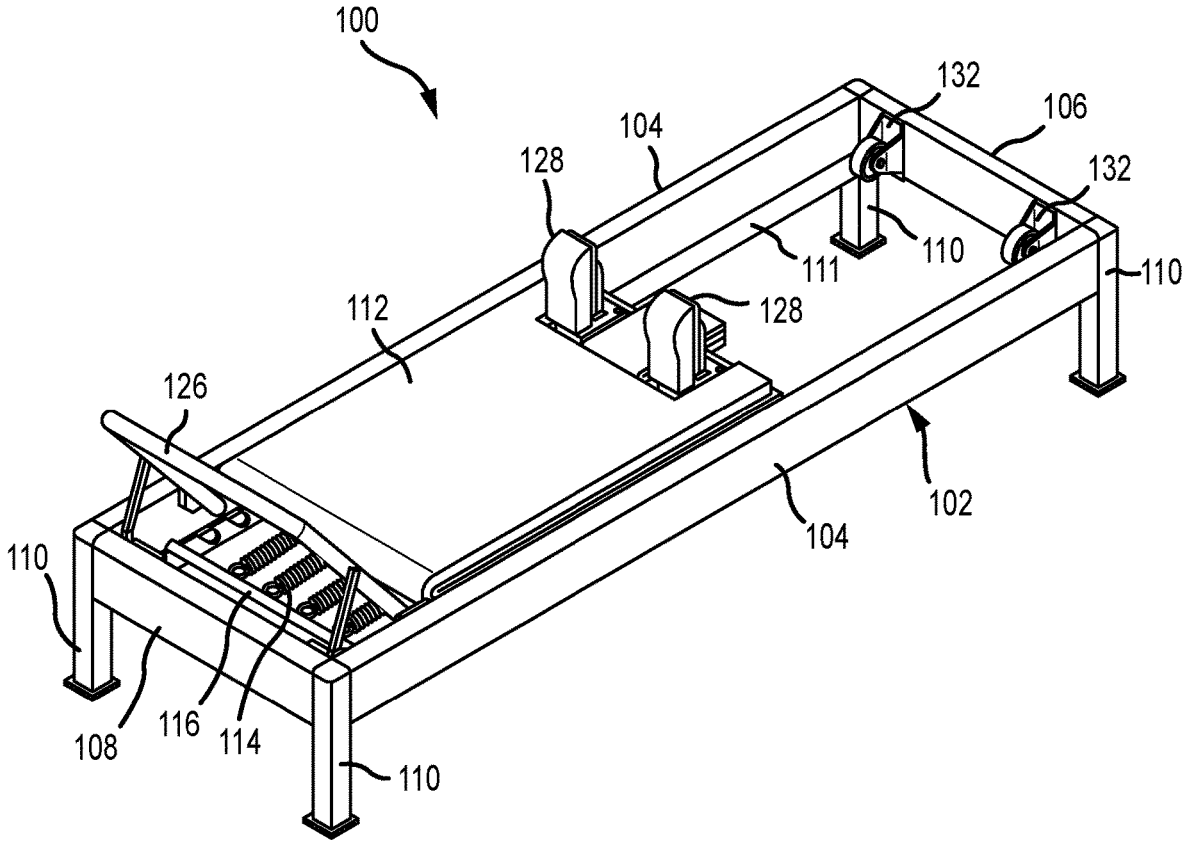
FIG. 1 is a perspective view from the foot end of a reformer exercise apparatus in accordance with the present disclosure.
Figure 2:
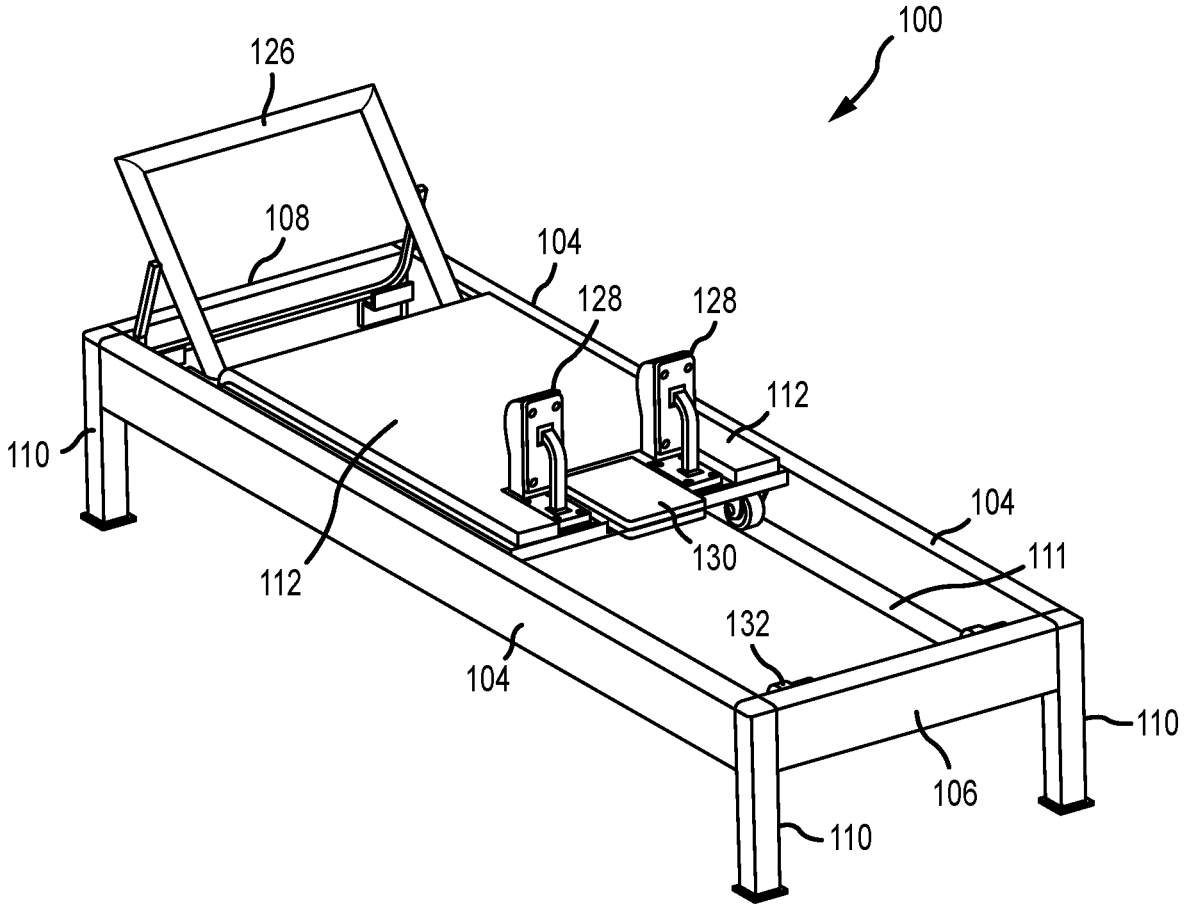
FIG. 2 is a head end perspective view of the reformer exercise apparatus shown in FIG. 1.

Turning now to the drawing figures, an exemplary reformer apparatus 100 in accordance with the present disclosure is shown in perspective views in FIGS. 1 and 2. The apparatus 100 includes a generally rectangular frame 102 that has a pair of parallel side rail members 104, a head end member 106, and a foot member 108 spacing the side rail members 104 apart. Each end of the side rail members 104 is joined to one of a head or foot member 106, 108 by a corner member 110. Each side rail member 104 includes a horizontally extending longitudinal flange 111 forming a track upon which a carriage 112 is mounted for back and forth movement between the head end member 106 and the foot end member 108. The carriage 112 is resiliently biased toward the foot end member 108 by one or more springs 114 connected to an anchor bar 116 fastened to the frame 102 adjacent the foot end member 108.

Figure 6:
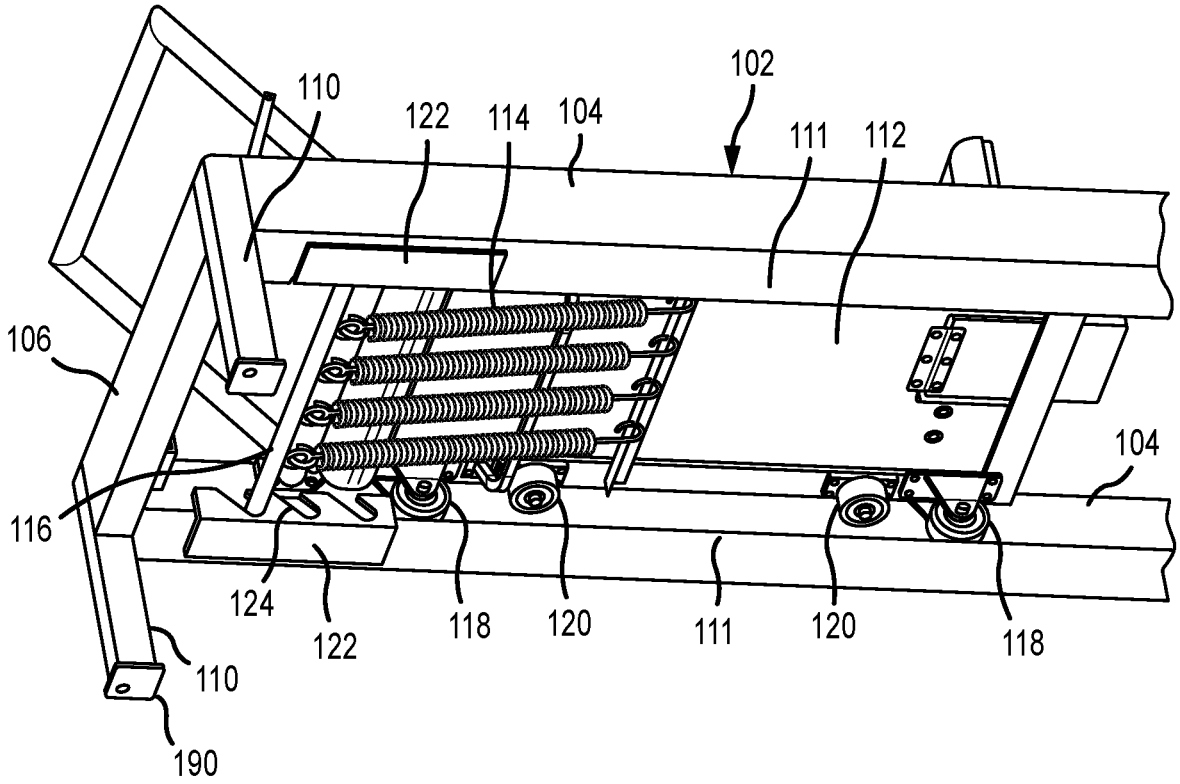
FIG. 6 is an underside perspective view of the foot end portion of the reformer apparatus shown in FIG. 1.

The carriage 112 has a set of four roller wheels 118 supporting the carriage 112 on the flange 111 of each side member 104 and four side guide rollers 120 (see FIG. 6) for maintaining the carriage 112 in proper alignment between the side members 104 during use. As shown in FIG. 6, each end of the anchor bar 116 is supported in one of a plurality of slots 124 in a bracket 122 fastened to one of the side members 104. The other end of each of the springs 114 is fastened to an underside of the carriage 112. Referring back to FIGS. 1 and 2, the reformer exercise apparatus 100 includes an adjustable foot bar 126 adjacent the foot end member 108. The carriage 112 has a pair of spaced apart shoulder stops 128 and a headrest 130 therebetween. A user can sit or recline on the carriage 112 and push his or her feet against the foot bar 126 to move the carriage 112 away from the foot end of the reformer apparatus 100. Alternatively, the user may pull arm cords (not shown) that run from the carriage 112 through pulleys 132 to hand grips (not shown) to also move the carriage 112 away from the foot end member 108 during exercise.

Figure 3:
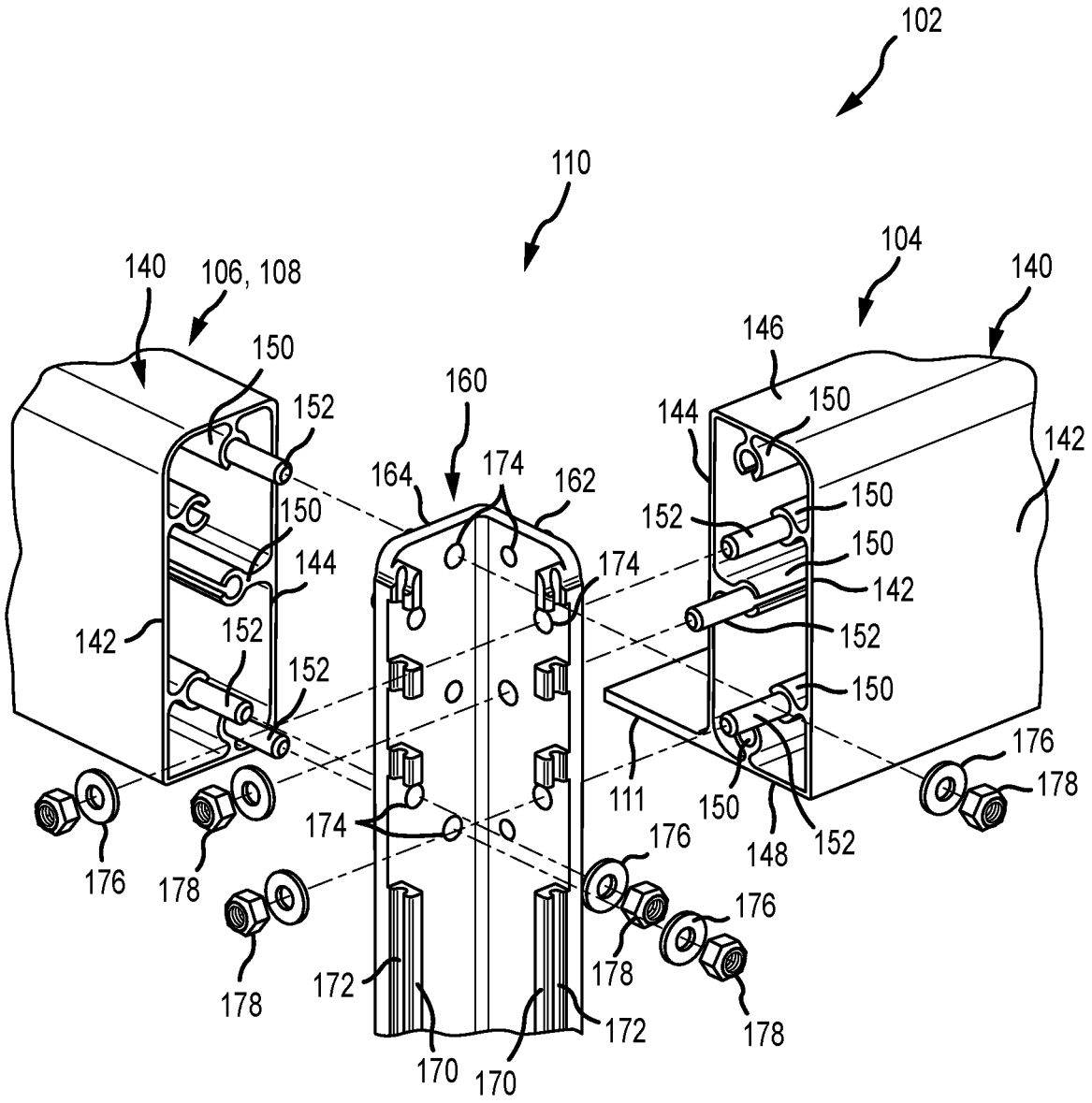
FIG. 3 is an exploded view of one corner joint of the frame of the reformer exercise apparatus shown in FIG. 1.
Figure 4:
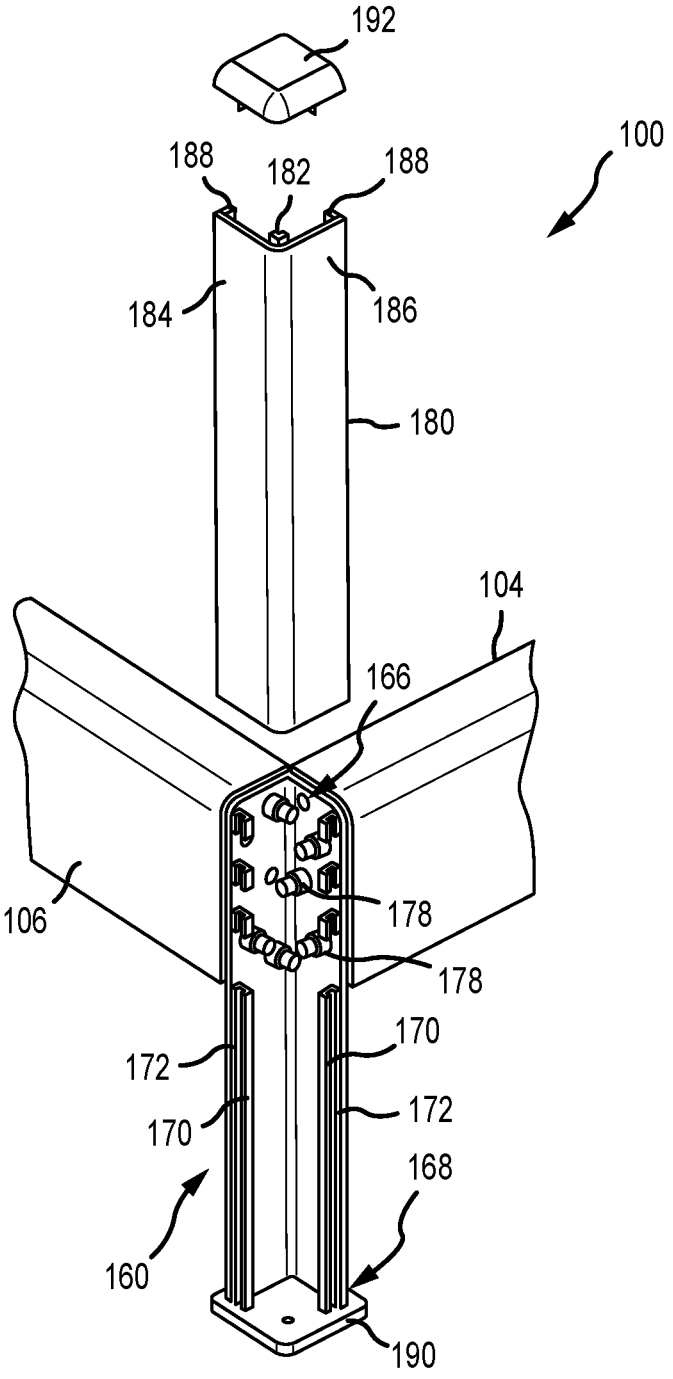
FIG. 4 is an exploded perspective view of the assembled corner joint shown in FIG. 3.

Turning now to FIGS. 3 and 4, FIG. 3 is an exploded view of one of the corner members 110 showing features of the extrusion side rail member 104, one of the end members 106, 108, and the internal connection components of the corner member 110. Each corner member 110 joins one of a head or foot end member 106 or 108 to one of the side rail members 104. FIG. 4 is an exploded view of the corner member 110 cover assembly components associated with each corner member 110.

Each side member 104 and each end member 106, 108 is a metal or rigid polymeric extrusion member 140 having, in cross section, an outer vertical wall 142, an inner vertical wall 144, a top wall 146 joining the outer vertical wall 142 to the inner vertical wall 144, and a bottom wall 148 joining the outer vertical wall 142 to the inner vertical wall 144. Each of the top wall 146, the bottom wall 148 and the inner vertical wall 144 has an interior projecting single screw race 150 formed therein. The outer vertical wall 142 has a pair of spaced apart interior projecting screw races 150 formed therein. The side members 104 each differs from the end members 106, 108 in that the side members 104 each have a longitudinally extending flange 111 projecting from the bottom wall 148 at a right angle to the inner vertical wall 144. This flange 111 serves as a track or rail supporting the roller wheels 118 of the carriage 112 described above.

As noted above, each of the inner vertical wall 144, the top wall 146 and bottom wall 148 of the extrusion members 140 has a single screw race 150 extending from the wall into the interior of the extrusion member 140 and extending lengthwise from the inside surface of the extrusion member 140. The outer vertical wall 142 of each extrusion member 140, however, has two equally spaced screw races 150 extending lengthwise from the inside surface of the extrusion into the interior space of the extrusion toward the screw race 150 projecting from the inner vertical wall 144. Each of the interior projecting screw races 150 in the outer wall 142 is preferably equidistant from the screw race 150 projecting from the inner vertical wall 144.

There are preferably three threaded studs 152 installed in three of the five races 150 in each of the members 104, 106 and 108. In particular, the outer vertical wall 142 carries two studs in its two spaced races 150 and one stud 152 in the race 150 extending from the inner wall 144. The end member 106, 108 carries one threaded stud in each of the races 150 in the top wall 146 and the bottom wall 148, and preferably one threaded stud 152 in either the upper or lower race 150 in the outer wall 142 of the end member 106 or 108 to which the side rail member 104 is to be connected.

Each corner member 110 includes a rigid elongated angle extrusion member 160 having an L shape cross section with a first leg 162 and a second leg 164 extending at a right angle from the first leg 162. The elongated angle member 160 has an upper end 166 and a bottom or lower end 168 and has a longitudinal boss 170 extending lengthwise adjacent the distal end or side of each leg 162 and 164. This boss 170 forms a longitudinal groove 172 for receiving a cover 180 described more fully below.

The upper end 166 of the angle extrusion member 160 has a set of five spaced apertures or apertures 174 through each leg 162 and 164 located complementary to the screw races 150 in each of the side rail members 104 and end members 106, 108. When either a side rail member 104 or an end member 106 or 108 is positioned with its top wall 146 flush with the upper end 166 of the corner angle extrusion member 160 and against one of the legs 162, 164, these apertures 174 each align directly with one of the screw races 150 in that side rail member 104 or end member 106, 108. The three studs 152 project through corresponding three of these apertures 174. A suitable washer 176 and nut 178 are then installed on each of the studs 152 to fasten the member 104, 106, 108 to the leg 162 or 164 of the corner angle member 160.

The other of the side rail member 104 or end member 106, 108 is likewise fastened to the other leg 162 or 164 in a similar fashion. When all six studs 152 are fastened to the corner angle extrusion member 160, the assembled corner member 110 will look like that shown in FIG. 4. Upper portions of the boss 170 are preferably machined away adjacent the apertures 174 to permit access of a suitable wrench (not shown) to tighten each of the nuts 178 in place. Only three of the apertures 174 in each leg 162, 164 are utilized to fasten the rail or end member 104, 106 or 108 to the corner extrusion 160. Furthermore, a different set of three apertures 174 are used depending on which member, a side rail member or end member 106 or 108, is abutting the leg 162 or 164 of the corner extrusion member 160. This particular arrangement permits wrench access to each of the studs 152 and nuts 178 with sufficient clearance for tightening of the nuts without interference with an adjacent nut.

Figure 7:
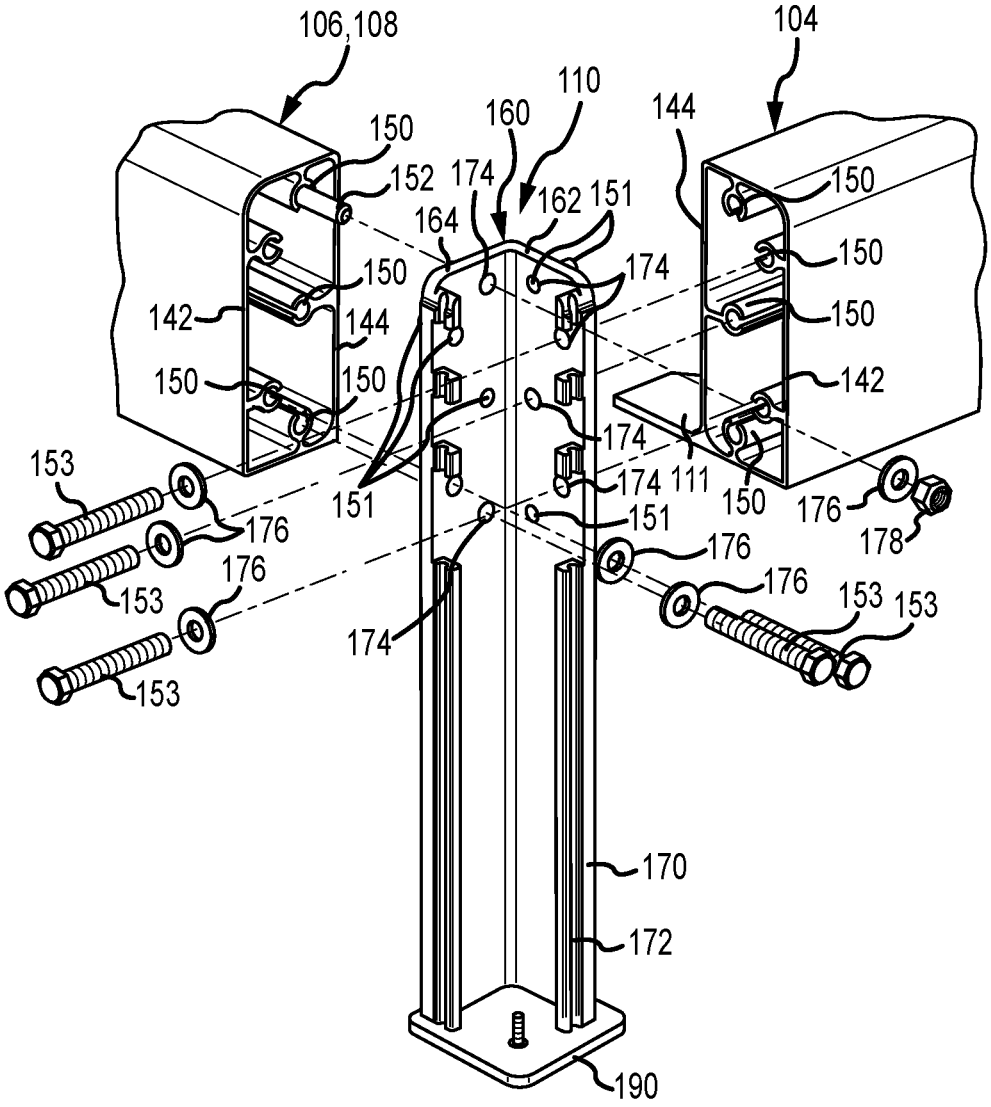
FIG. 7 is an exploded view of an alternative configuration of a corner joint of the frame of the reformer exercise apparatus shown in FIG. 1.

An alternative assembly of the corner member 110 to that shown in FIG. 3 is shown exploded in FIG. 7. In this alternative each corner member 110 again includes a rigid elongated angle extrusion member 160 having an L shape cross section with a first leg 162 and a second leg 164 extending at a right angle from the first leg 162. The elongated angle member 160 has an upper end 166 and a bottom or lower end 168 and has a longitudinal boss 170 extending lengthwise adjacent the distal end or side of each leg 162 and 164. This boss 170 forms a longitudinal groove 172 for receiving the cover 180 described more fully below.

The upper end 166 of the angle extrusion member 160 has a set of five spaced holes or apertures 174 through each leg 162 and 164 located complementary to the screw races 150 in each of the side rail members 104 and end members 106, 108. In FIG. 7, the end member 106 or 108 has a stud 152 protruding from the top screw race 150. When the rail member 104 or an end member 106 or 108 is positioned with its top wall 146 flush with the upper end 166 of the corner angle extrusion member 160 and against one of the legs 162, 164, these apertures 174 each align directly with one of the screw races 150 in that side rail member 104 or end member 106, 108. One stud 152 projects through a corresponding top one of the apertures 174. A suitable washer 176 and nut 178 are then installed on the stud 152 to fasten the member 106, 108 to the leg 162 or 164 of the corner angle member 160. The angle extrusion member 160 has a plurality of press pins 151 pressed into the apertures 174 that will not be used for passage of fasteners, in this case, bolts 153 shown in FIG. 7, that extend into corresponding screw races 150 in the abutting side rail member 104 or end member 106, 108.

As shown in FIG. 7, there are three press pins 151 that align each of the leg 162 and 164 to the abutting member 104 or 106, 108. Each of these pins 151 is frictionally press fit into one of the apertures 174 as shown and has a protruding distal end which is sized to extend into one of the screw races 150. In particular, preferably the upper and lower screw races 150 in the side rail member 104 receive press pins 151 so as to align the remaining three screw races 150 in the inner and outer walls with the corresponding apertures 174 in leg 162 of the angle extrusion member 160. These three screw races each receive a bolt 153 that fastens the member 104 to the leg 162. The screw races 150 in the outer and inner walls 144 and 142 of the end member 106, 108 similarly align with and receive press pins 151 protruding outward from the apertures 174 in the other leg 164 of the angle extrusion member 160. These press pins 151 along with the stud 152 installed in the upper screw race 150 of the end member 106, 108 ensure precise alignment of the end member 106, 108 with the leg 164 of the angle extrusion member 160. Two bolts 153 pass through the remaining apertures 174 in the leg 164 into the aligned screw races 150. Thus the end member 106, 108 is fastened to the angle extrusion 160 via these two bolts 153 and the stud 152 via a nut 178 installed thereon.

When all six fasteners, either studs 152 with nuts 178 or bolts 153 are fastened to the corner angle extrusion member 160, the assembled corner member 110 will essentially look like that shown in FIG. 4. Upper portions of the boss 170 are preferably machined away adjacent the apertures 174 to permit access of a suitable wrench (not shown) to tighten each of the bolts 153 or nuts 178 in place. Only three of the apertures 174 in each leg 162, 164 are utilized to fasten the rail or end member 104, 106 or 108 to the corner extrusion 160. Preferably the other two apertures 174 in each leg 162, 164 receive press pins 151. Furthermore, different sets of three apertures 174 are used for fasteners depending on which member, a side rail member or end member 106 or 108, is abutting the leg 162 or 164 of the corner extrusion member 160. This particular arrangement permits wrench access to each of the studs 152 and nuts 178 or bolts 153 with sufficient clearance for tightening of the bolts or nuts without interference with an adjacent nut or bolt head.

Turning now to the exploded view in FIG. 4, the corner member 110 also includes an elongated cover 180, a top cover 182, and a bottom foot 184 that together hide the connections between the head and foot end member 106 or 108 and the side rail member 104 thereby presenting a smooth corner joint assembly to the frame 102.

The elongated cover 180 is preferably an elongated metal or polymer extrusion having an L shaped cross section and having a single longitudinal internal screw race 182 formed along the apex between the legs 184 and 186 of the extrusion. The outer edges of each leg 184 and 186 has a rib like boss 188 extending therealong that fits within the groove 172 along each leg 164 and 166 of the corner angle extrusion 160. To assemble to cover 180, one slides the extrusion 180 downward along the length of the corner extrusion 160 so that the rib like bosses 188 fully engage the grooves 172 until the cover 180 is fully seated down alongside the extrusion 160.

A foot pad 190 has a aperture therethrough that aligns with the screw race 182. A suitable screw is inserted through the aperture in the foot pad 190 and threaded into the race 182 to hold the cover 180 in place.

Figure 5:
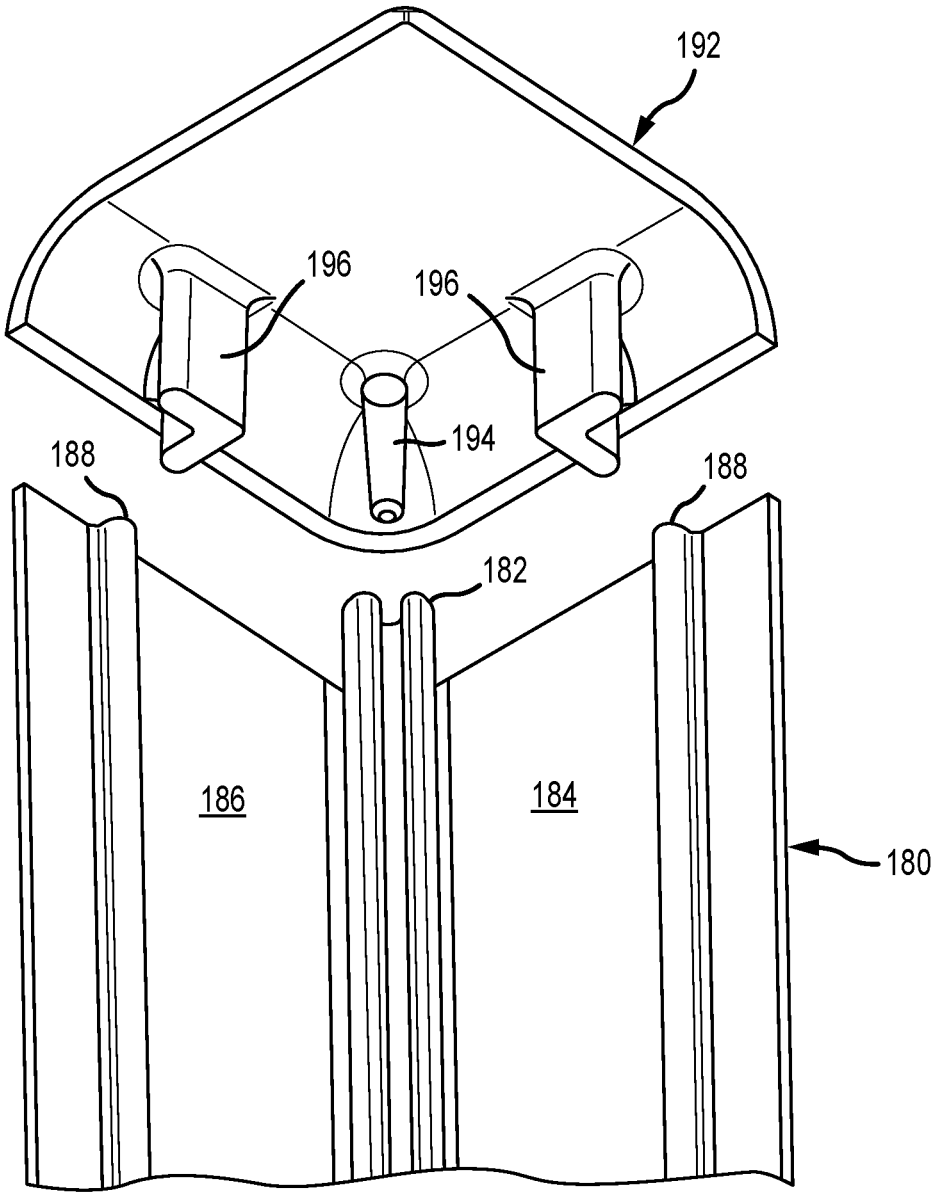
FIG. 5 is a partial exploded view of the corner leg cover assembly shown in FIG. 4.

FIG. 5 shows an exploded view of the upper end of the cover 180 and underside of the top cap 192 separate from the corner angle extrusion 160. This top cap 192 has a smooth upper surface for joining or abutting against the upper sides 146 of the end member 106, 108 and rail member 104 joined as shown in FIG. 4. The underside of the top cap 192 has a tapered stub 194 projecting therefrom adjacent its outer corner spaced and aligned to frictionally fit within the screw race 182 in the cover 180. The underside of the top cap 192 also has two corner or L shaped bosses 196 projecting therefrom positioned to frictionally engage against the sides of the bosses 170 adjacent the upper end 166 of the extrusion 160 to firmly fasten the top cap 192 to the corner extrusion 160.

Together the cover 180, the foot 190 and the top cap 192, when installed on the corner angle extrusion 160, present a smooth corner 110 joining the side rail member 104 to one of the end members 106 or 108 such that the actual joint technique is hidden from view. To disassemble the corner member 110, the screw through the foot pad 190 is removed and the cover 180 pushed upward until the ribs 188 disengage from the grooves 172. The nuts 178 may then be accessed for disassembly from the studs 152 in a conventional manner.

Many changes may be made to the apparatus, which will become apparent to a reader of this disclosure. For example, the corner cover 180 and top cap 192 may be formed as a single member or may be permanently fastened together via cement or other permanent joint. The upper screw race 150 in the end member 106 may be utilized instead of the lower screw race 150 in the outer vertical wall 144 as shown in FIGS. 3 and 4. Although illustrated in FIG. 3, the side rail member 104 having studs 152 in the inner three races 150 in the outer and inner vertical walls 142 and 144 respectively, may be reversed with those of the end members 106 and 108 such that the combination is reversed, without the necessity of relocating the apertures 174. If the dimensions of the side rail member 104 and 106 and 108 are larger, then all five races 150 in each member may incorporate studs 152 provided sufficient space exists for engaging the adjacent nuts 178 in the assembled corner member 110.

Studs 152 and nuts 178 and/or bolts 153 may be interchangeably utilized in the embodiments set forth in this disclosure. Furthermore, the use of five apertures 174 and five races 150 is merely exemplary. A different number and orientation of these elements may be utilized. Therefore all such changes, alternatives and equivalents in accordance with the features and benefits described herein, are within the scope of the present disclosure. Any or all of such changes and alternatives may be introduced without departing from the spirit and broad scope of my disclosure and invention as defined by the claims below and their equivalents.

What is claimed is:

1. An exercise apparatus comprising:

a rectangular frame having a pair of spaced apart side rail members, a head end member and a foot end member;

a corner member abutting against and joining one end of each side rail member to one end of each one of the end members;

a carriage positioned between the side rail members for movement back and forth between the rails; and an elastic member fastened between the foot end member and the carriage biasing the carriage toward the foot end member;

wherein each of the side rail members and each end member is a rigid extrusion having, in cross section, an outer vertical wall, an inner vertical wall, a top wall joining the outer vertical wall to the inner vertical wall, and a bottom wall joining the outer vertical wall to the inner vertical wall, each of the top wall, the bottom wall and the inner vertical wall having an interior projecting single screw race formed therein, and the outer vertical wall having a pair of spaced interior projecting screw races formed therein and wherein each side rail member and end member has fasteners each extending from one of the screw races into the corner member abutting against and joined thereto.

2. The exercise apparatus according to claim 1 wherein each corner member is a rigid elongated extrusion having an L shape cross section having a first leg and a second leg extending at a right angle from the first leg.

3. The exercise apparatus according to claim 2 wherein each corner member has a boss formed at the distal end of each leg, the boss forming an elongated groove for receiving an elongated corner cover to hide the fasteners from view.

4. The exercise apparatus according to claim 3 wherein each side rail member extrusion has a flat flange extending from the bottom wall at a right angle from the inner wall adjacent the bottom wall.

5. The exercise apparatus according to claim 4 further comprising:

a top cover shaped to cover the upper end of the rigid extrusion and a top end portion of the corner cover; and a foot pad receiving a bottom end of the rigid extrusion.

6. The corner member according to claim 5 wherein the elongated corner cover has an internally facing screw race between the sides for receiving a fastener through the foot pad.

7. The exercise apparatus according to claim 3 wherein the inner vertical wall screw race is equidistant from the top wall and the bottom wall.

8. The exercise apparatus according to claim 7 wherein the pair of spaced interior projecting screw races in the outer vertical wall are equidistantly spaced from the inner vertical wall screw race.

9. The exercise apparatus according to claim 3 wherein the elongated corner cover has an L shaped cross section.

10. The exercise apparatus according to claim 2 wherein each corner member is fastened to one of the end members and one of the side members by threaded fasteners each projecting from one of the screw races.

11. The exercise apparatus according to claim 1 wherein the inner vertical wall screw race is equidistant from the top wall and the bottom wall.

12. The exercise apparatus according to claim 11 wherein the pair of spaced interior projecting screw races in the outer vertical wall are equidistantly spaced from the inner vertical wall screw race.

13. The exercise apparatus according to claim 1 wherein each side rail member extrusion has a flat flange extending from the bottom wall at a right angle from the inner wall adjacent the bottom wall.

14. The exercise apparatus according to claim 1 wherein the screw races formed in the walls of each side rail member and head and foot end member are identically located within the extrusions.

15. An exercise apparatus comprising:

a rectangular frame having a pair of spaced apart side rail members, a head end member and a foot end member;

a corner member joining one end of each side rail member to one end of each one of the end members;

a carriage positioned between the side rail members for movement back and forth between the rails; and an elastic member fastened between the foot end member and the carriage biasing the carriage toward the foot end member;

wherein each of the side rail members and each end member is a rigid extrusion having, in cross section, an outer vertical wall, an inner vertical wall, a top wall joining the outer vertical wall to the inner vertical wall, and a bottom wall joining the outer vertical wall to the inner vertical wall, each of the top wall, the bottom wall and the inner vertical wall having an interior projecting single screw race formed therein, and the outer vertical wall having a pair of spaced interior projecting screw races formed therein, wherein each corner member is a rigid elongated extrusion having an L shape cross section having a first leg and a second leg extending at a right angle from the first leg, wherein each corner member has an upper end and a lower end and a plurality of apertures through each leg adjacent the upper end, each aperture being in a position opposite one of the screw races in the one of the side rail member or end member abutting the corner member.

16. The exercise apparatus according to claim 15 wherein each leg of the corner member receives three fasteners extending through three apertures from or into corresponding screw races in one of the rail member and one of the end member.

17. The exercise apparatus according to claim 16 wherein at least one fastener comprises a threaded stud threaded into one of the screw races and the apparatus further includes a nut fastened to the at least one threaded stud protruding through one of the apertures.

18. An exercise apparatus comprising:

a rectangular frame having a pair of spaced apart side rail members, a head end member and a foot end member;

a corner member joining one end of each side rail member to one end of each one of the end members;

a carriage positioned between the side rail members for movement back and forth between the rails; and an elastic member fastened between the foot end member and the carriage biasing the carriage toward the foot end member;

wherein each of the side rail members and each end member is a rigid extrusion having, in cross section, an outer vertical wall, an inner vertical wall, a top wall joining the outer vertical wall to the inner vertical wall, and a bottom wall joining the outer vertical wall to the inner vertical wall, each of the top wall, the bottom wall and the inner vertical wall having an interior projecting single screw race formed therein, and the outer vertical wall having a pair of spaced interior projecting screw races formed therein, wherein each corner member is a rigid elongated extrusion having an L shape cross section having a first leg and a second leg extending at a right angle from the first leg, wherein each side rail member and end member has a plurality of threaded fasteners each extending from one of the screw races through a corresponding aperture through one of the legs of the corner member.

19. The exercise apparatus according to claim 18 wherein each corner member has a boss formed at the distal end of each leg, the boss forming an elongated groove for receiving a cover to hide the threaded fasteners from view.

* * * * *